US008439162B1

(12) United States Patent
Galloway

(10) Patent No.: US 8,439,162 B1
(45) Date of Patent: May 14, 2013

(54) TREE MOUNTED LADDER ASSEMBLY

(76) Inventor: Kevin S. Galloway, Salem, SC (US)

( * ) Notice: Subject to any disclaimer, the term of this patent is extended or adjusted under 35 U.S.C. 154(b) by 0 days.

(21) Appl. No.: 13/331,813

(22) Filed: Dec. 20, 2011

(51) Int. Cl.
*E06C 1/10* (2006.01)
*E06C 9/00* (2006.01)

(52) U.S. Cl.
USPC ..... 182/100; 182/189; 182/92

(58) Field of Classification Search ..... 182/100, 182/189, 92; 248/220.43, 221.12
See application file for complete search history.

(56) References Cited

U.S. PATENT DOCUMENTS 591,418 A * 10/1897 Noyes ..... 182/189
1,305,107 A * 5/1919 Hogan ..... 182/163
1,657,939 A * 1/1928 Rockwell ..... 248/73
3,995,714 A * 12/1976 Brookes et al. ..... 182/100
D256,260 S * 8/1980 Lay, Jr. ..... D21/422
4,762,200 A 8/1988 Andrews et al.
5,279,388 A 1/1994 Laughlin et al.
5,439,072 A 8/1995 Jenkins, Jr.
5,752,580 A 5/1998 Jenkins, Jr.
5,816,362 A 10/1998 Jenkins, Jr.
6,006,864 A 12/1999 Musk
6,269,906 B1 * 8/2001 Dockter et al. ..... 182/92
6,305,497 B1 10/2001 Simon
6,340,071 B1 1/2002 Diekemper
6,668,975 B2 12/2003 Skipper
7,163,082 B2 1/2007 Bigard
2003/0141147 A1 * 7/2003 Skipper ..... 182/100
2004/0216952 A1 * 11/2004 Woller ..... 182/93

* cited by examiner

*Primary Examiner* — Alvin Chin Shue

(57) ABSTRACT

A tree mounted ladder assembly provides adjustable spacing between steps to facilitate climbing into a tree. The assembly includes an elongated bar, an upper support coupled to the bar; and a lower support coupled to the bar. A connector is also coupled to the bar and a strap is coupled to the connector. The strap is configured for coupling around a tree to hold the upper support and the lower support against the tree. A plurality of steps is coupled to the bar.

16 Claims, 6 Drawing Sheets

TREE MOUNTED LADDER ASSEMBLY

BACKGROUND OF THE DISCLOSURE

Field of the Disclosure

The disclosure relates to ladder devices and more particularly pertains to a new ladder device for providing adjustable spacing between steps to facilitate climbing into a tree.

SUMMARY OF THE DISCLOSURE

An embodiment of the disclosure meets the needs presented above by generally comprising an elongated bar, an upper support coupled to the bar; and a lower support coupled to the bar. A connector is also coupled to the bar and a strap is coupled to the connector. The strap is configured for coupling around a tree to hold the upper support and the lower support against the tree. A plurality of steps is coupled to the bar.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
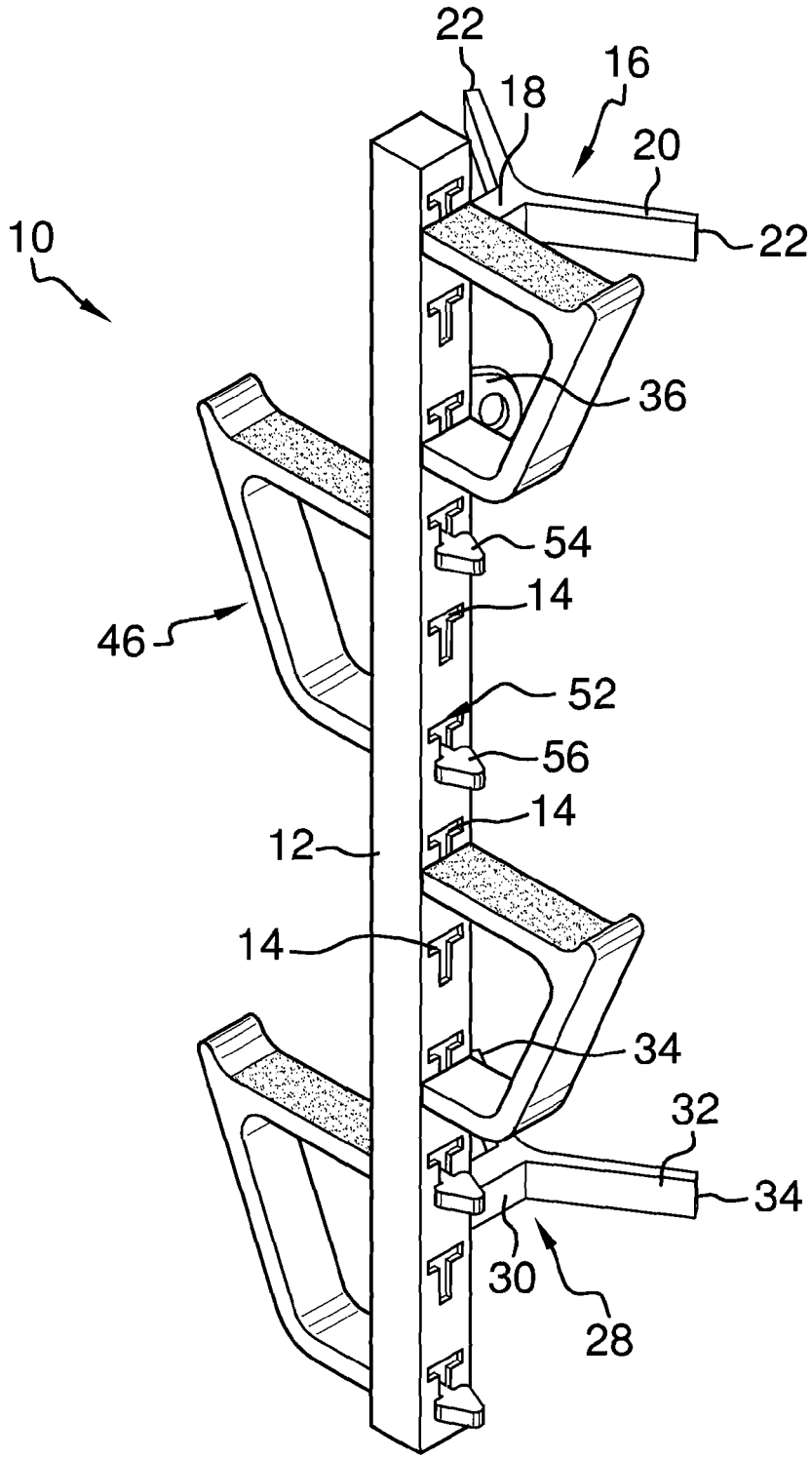
FIG. 1 is a top front side perspective view of a tree mounted ladder assembly according to an embodiment of the disclosure.
Figure 2:
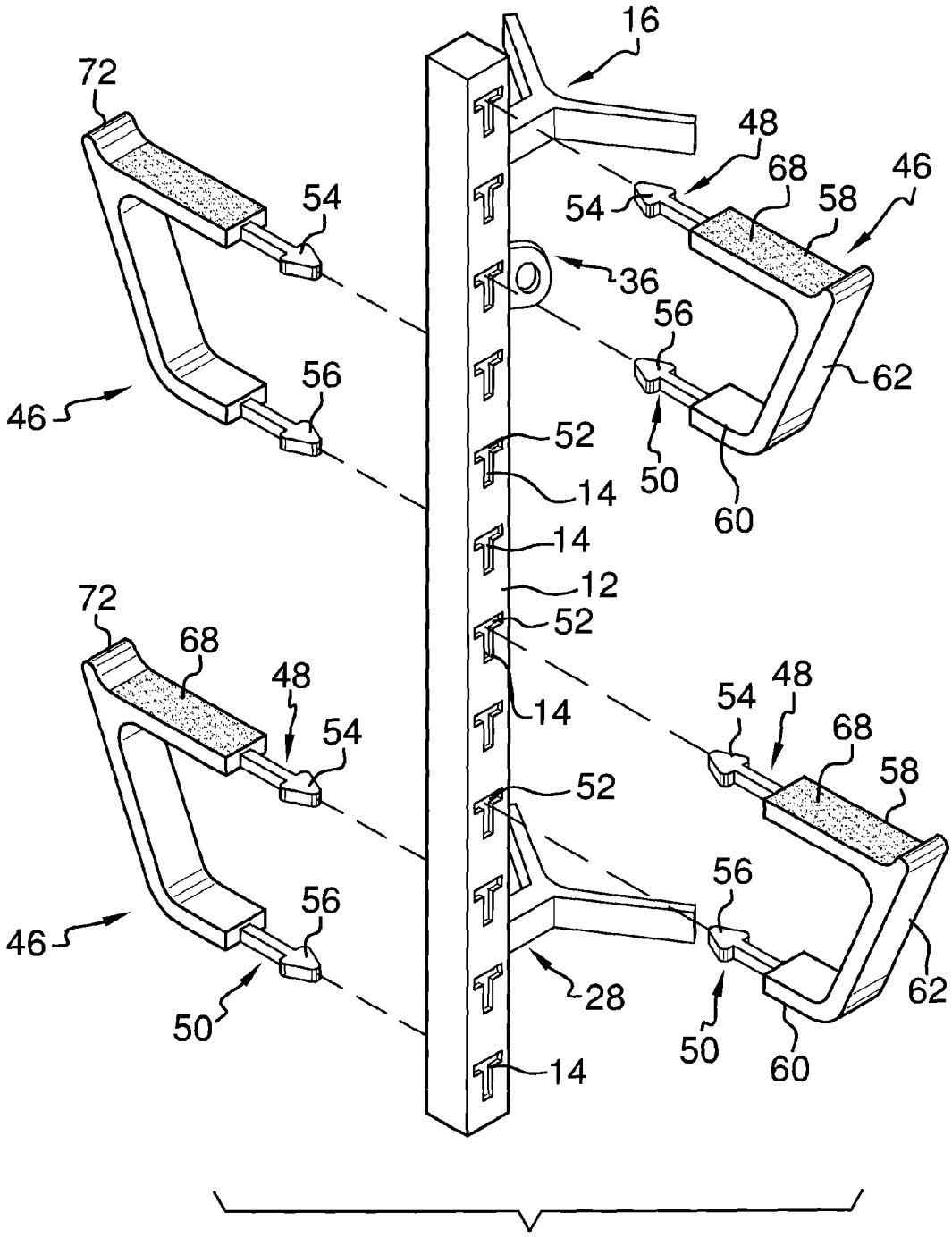
FIG. 2 is an exploded top front side perspective view of an embodiment of the disclosure.
Figure 3:
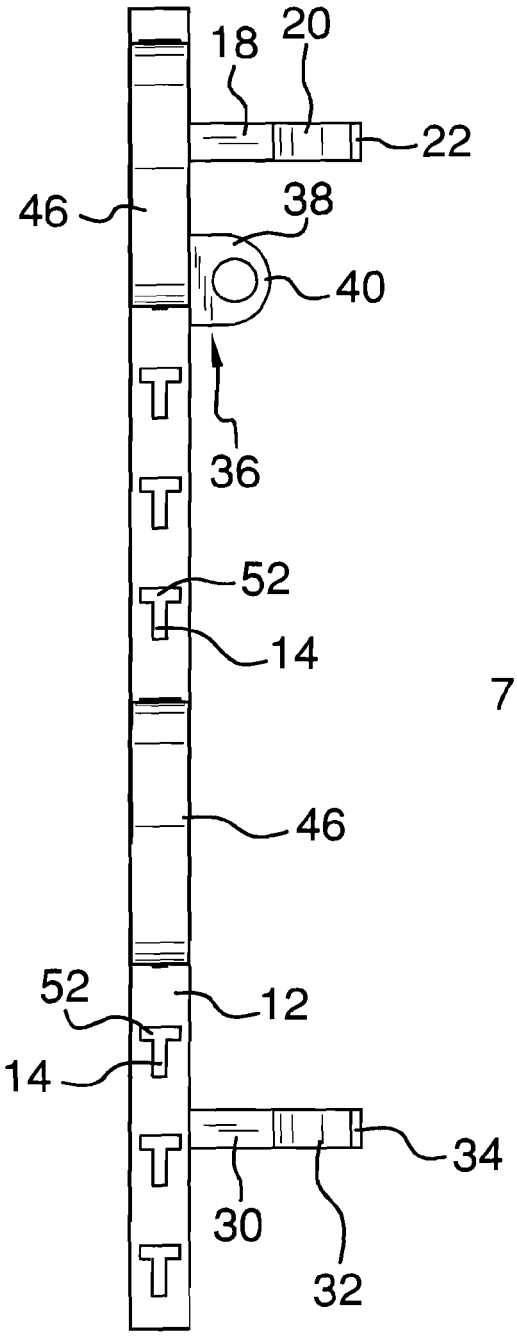
FIG. 3 is a side view of an embodiment of the disclosure.
Figure 4:
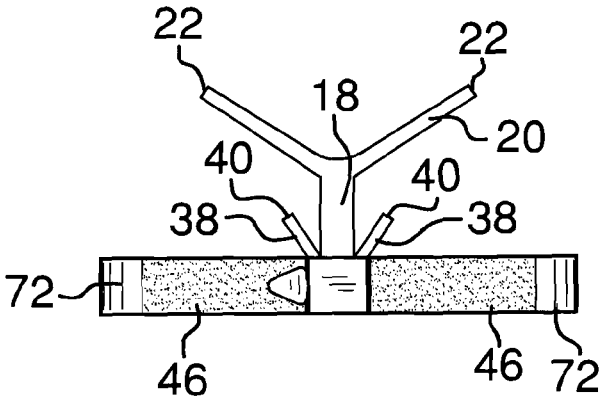
FIG. 4 is a top view of an embodiment of the disclosure.
Figure 5:
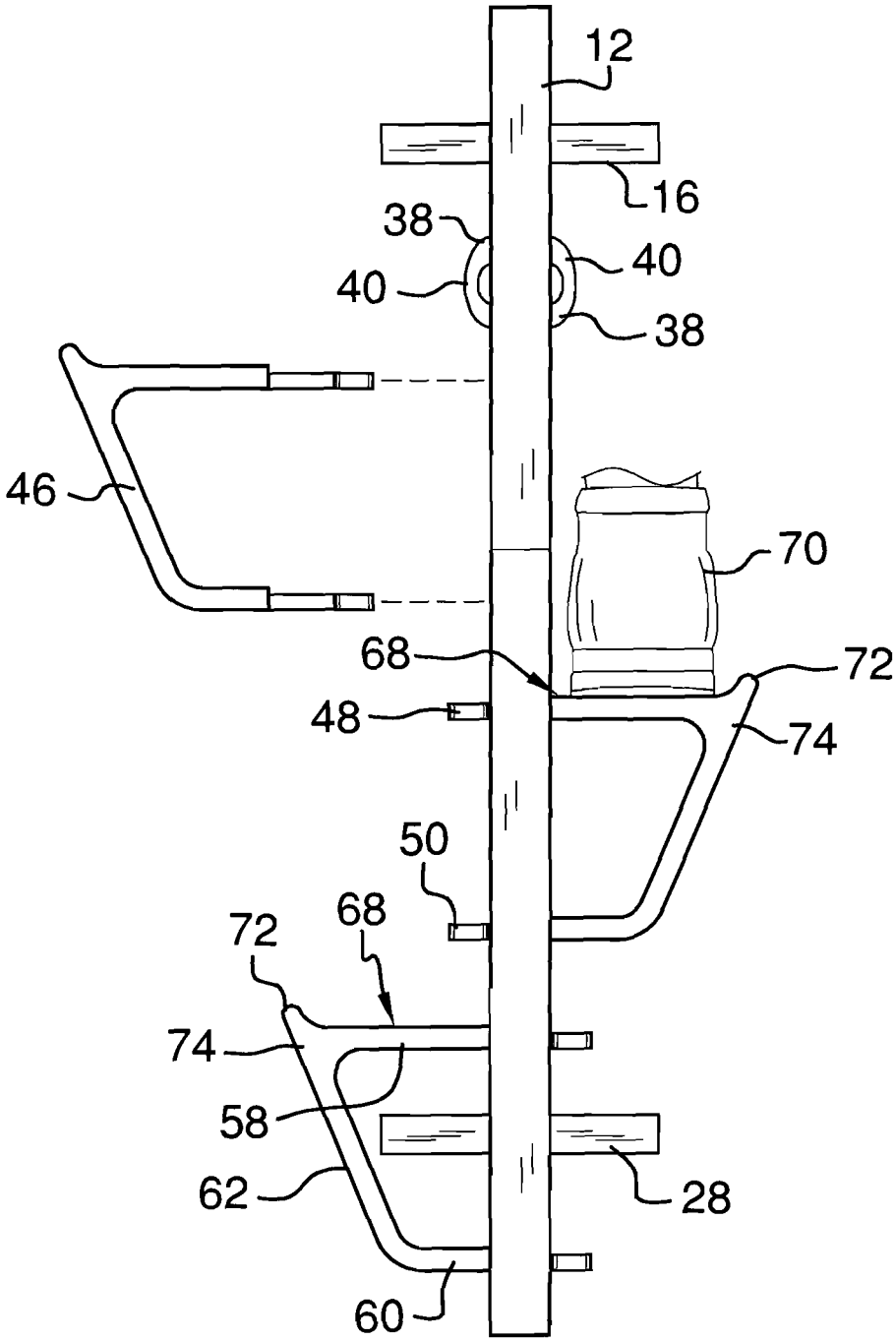
FIG. 5 is a partially exploded front view of an embodiment of the disclosure.
Figure 6:
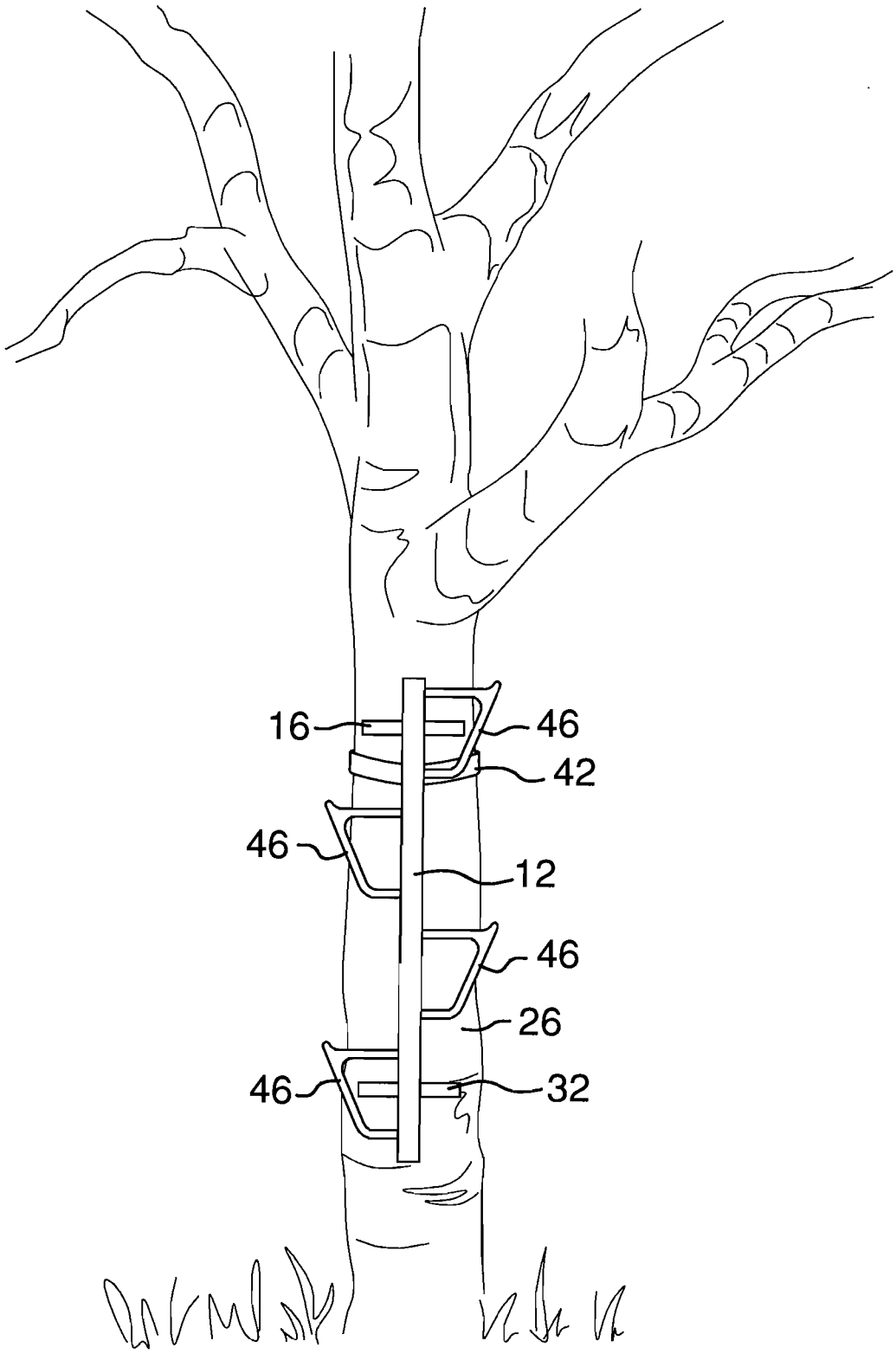
FIG. 6 is a front view of an embodiment of the disclosure in use.
Figure 7:
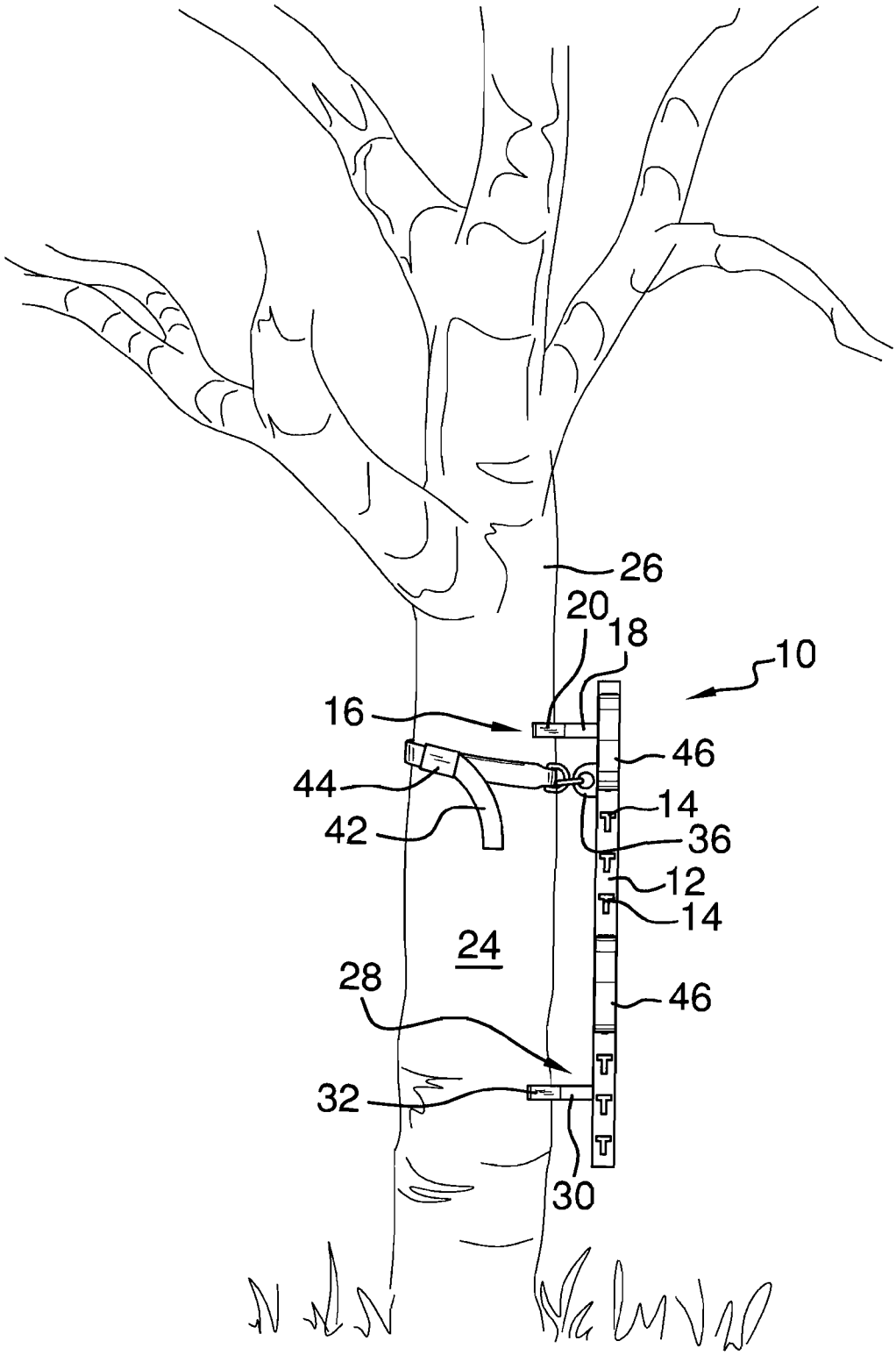
FIG. 7 is a side view of an embodiment of the disclosure in use.

With reference now to the drawings, and in particular to FIGS. 1 through 7 thereof, a new ladder device embodying the principles and concepts of an embodiment of the disclosure and generally designated by the reference numeral 10 will be described.

As best illustrated in FIGS. 1 through 7, the tree mounted ladder assembly 10 generally comprises an elongated bar 12 having a plurality of T-shaped apertures 14 extending laterally through the bar 12. An upper support 16 is coupled to the bar 12. The upper support 16 has a connection portion 18 and an arcuate abutment portion 20. The abutment portion 20 of the upper support 16 has opposite ends 22 extending away from the bar 12 whereby the abutment portion 20 of the upper support 16 is configured for extending around an outer surface 24 of a tree 26. Similarly, a lower support 28 is coupled to the bar 12. The lower support 28 has a connection portion 30 and an arcuate abutment portion 32. The abutment portion 32 of the lower support 28 has opposite ends 34 extending away from the bar 12 whereby the abutment portion 32 of the lower support 28 is configured for extending around the outer surface 24 of the tree 26.

A connector 36 is coupled to the bar 12. The connector 36 may have a pair of loops 38 extending outwardly from the bar 12 such that outer portions 40 of the loops 38 are positioned in spaced relationship to each other. A strap 42 is coupled to the connector 38. The strap 42 is configured for coupling around the tree 26 whereby the upper support 16 and the lower support 28 are positioned against the tree 26. A buckle 44 may be coupled to the strap 42 such that the strap 42 may be cinched tightly against the tree 26 to hold the bar 12 securely.

A plurality of steps 46 is provided. Each step 46 may be coupled to the bar 12. Each step 46 has an upper catch 48 and a lower catch 50. The upper catch 48 is insertable through a selectable one of the apertures 14 whereby each step 46 is couplable to the bar 12. The upper catch 48 may be planar such that the upper catch 48 is insertable through an upper flange 52 of each aperture 14. The upper catch 48 also has a barbed end portion 54 engaging the bar 12 when the upper catch 48 is fully inserted through the aperture 14 and the upper catch 48 is moved downwardly from the upper flange 52 of the aperture 14. Similarly, each lower catch 50 is insertable through a selectable one of the apertures 14 whereby each step 46 is held in a static position relative to the bar 12 when the step 46 is coupled to the bar 12. Thus, each step 46 is prevented from twisting on the bar 12. The lower catch 50 is planar whereby the lower catch 50 is insertable through the upper flange 52 of each aperture 14. The lower catch 50 has a barbed end portion 56. The barbed end portion 56 of the lower catch 50 engages the bar 12 when the lower catch 50 is fully inserted through the aperture 14 and the lower catch 50 is moved downwardly from the upper flange 52 of the aperture 14.

Each step 46 has an upper beam 58, a lower beam 60 and a cross-beam 62 coupled to and extending between the upper beam 58 and the lower beam 60. The upper beam 58 has a planar upper surface 68 configured to support a foot 70 positioned on the upper beam 58. Each step 46 may have a prong 72 extending from a junction 74 between the upper beam 58 and the cross-beam 62. Thus, the prong 72 is configured for restricting lateral movement of the foot 70 while the foot 70 is supported on the step 46. The upper beam 58 may have a length greater than a length of the lower beam 60.

In use, the bar 12 is positioned against the tree 26 and the strap 42 is cinched tight to urge the upper support 16 and lower support 28 against the tree 26. The steps 46 are coupled to the bar 12 by insertion of the upper catch 58 and lower catch 60 through selected apertures 14. The steps 46 are positioned on alternating sides of the bar 12 and spaced as desired. The user may then use the steps 46 to facilitate climbing into the tree.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A ladder assembly comprising:

an elongated bar;

an upper support coupled to said bar;

a lower support coupled to said bar;

a connector coupled to said bar;

a strap coupled to said connector, said strap being configured for coupling around a tree whereby said upper support and said lower support are positioned against the tree;

a plurality of steps, each step being removably coupled to said bar;

each said step having an upper beam, a lower beam and a cross-beam coupled to and extending between said upper beam and said lower beam, said upper beam being configured to support a foot positioned on said upper beam, said upper beam having a length greater than a length of said lower beam, further comprising:

a plurality of apertures extending through said bar; and each step having an upper catch, said upper catch being insertable through a selectable one of said apertures whereby each said step is couplable to said bar, each said step having a lower catch, each lower catch being insertable through a selectable one of said apertures whereby each said step is held in a static position relative to said bar when said step is coupled to said bar, wherein each step has a height distance defined between said upper catch and said lower catch, said distance between said upper catch and said lower catch being greater than a distance between adjacent ones of said apertures.

2. The assembly of claim 1, further including a buckle coupled to said strap.

3. The assembly of claim 1, further including said upper support having a connection portion and an arcuate abutment portion.

4. The assembly of claim 3, further including said abutment portion of said upper support having opposite ends extending away from said bar whereby said abutment portion of said upper support is configured for extending around an outer surface of the tree.

5. The assembly of claim 1, further including said lower support having a connection portion and an arcuate abutment portion.

6. The assembly of claim 5, further including said abutment portion of said lower support having opposite ends extending away from said bar whereby said abutment portion of said lower support is configured for extending around an outer surface of the tree.

7. The assembly of claim 1, further including each aperture being T-shaped.

8. The assembly of claim 7, further including said upper catch being planar whereby said upper catch is insertable through an upper flange of each said aperture.

9. The assembly of claim 8 further including said upper catch having a barbed end portion, said barbed end portion of said upper catch engaging said bar when said upper catch is fully inserted through said aperture and said upper catch is moved downwardly from said upper flange of said aperture.

10. The assembly of claim 1, further comprising:

each said aperture being T-shaped; and said lower catch being planar whereby said lower catch is insertable through an upper flange of each said aperture.

11. The assembly of claim 8 further including said lower catch having a barbed end portion, said barbed end portion of said lower catch engaging said bar when said lower catch is fully inserted through said aperture and said lower catch is moved downwardly from said upper flange of said aperture.

12. The assembly of claim 1, further including said connector having a pair of loops, each of said loops extending outwardly from said bar such that outer portions of said loops are positioned in spaced relationship to each other.

13. The assembly of claim 1, further including each said step having a prong extending from a junction between said upper beam and said cross-beam whereby said prong is configured for restricting lateral movement of the foot while the foot is supported on said step.

14. The assembly of claim 1, wherein said upper and lower beams are orientated parallel to each other.

15. The assembly of claim 1, wherein each of said upper and lower catches extends through opposite sides of said elongated bar.

16. A ladder assembly comprising:

an elongated bar;

a plurality of T-shaped apertures extending through said bar;

an upper support coupled to said bar, said upper support having a connection portion and an arcuate abutment portion, said abutment portion of said upper support having opposite ends extending away from said bar whereby said abutment portion of said upper support is configured for extending around an outer surface of the tree;

a lower support coupled to said bar, said lower support having a connection portion and an arcuate abutment portion, said abutment portion of said lower support having opposite ends extending away from said bar whereby said abutment portion of said lower support is configured for extending around an outer surface of the tree;

a connector coupled to said bar, said connector having a pair of loops, each of said loops extending outwardly from said bar such that outer portions of said loops are positioned in spaced relationship to each other;

a strap coupled to said connector, said strap being configured for coupling around a tree whereby said upper support and said lower support are positioned against the tree;

a buckle coupled to said strap; and a plurality of steps, each step being removably coupled to said bar, each step having an upper catch, said upper catch being insertable through a selectable one of said apertures whereby each said step is couplable to said bar, said upper catch being planar whereby said upper catch is insertable through an upper flange of each said aperture, said upper catch having a barbed end portion, said barbed end portion of said upper catch engaging said bar when said upper catch is fully inserted through said aperture and said upper catch is moved downwardly from said upper flange of said aperture, each said step having a lower catch, each lower catch being insertable through a selectable one of said apertures whereby each said step is held in a static position relative to said bar when said step is coupled to said bar, said lower catch being planar whereby said lower catch is insertable through an upper flange of each said aperture, said lower catch having a barbed end portion, said barbed end portion of said lower catch engaging said bar when said lower catch is fully inserted through said aperture and said lower catch is moved downwardly from said upper flange of said aperture, each said step having an upper beam, a lower beam and a cross-beam coupled to and extending between said upper beam and said lower beam, said upper beam being configured to support a foot positioned on said upper beam, each said step having a prong extending from a junction between said upper beam and said cross-beam whereby said prong is configured for restricting lateral movement of the foot while the foot is supported on said step, said upper beam having a length greater than a length of said lower beam, wherein each step has a height distance defined between said upper catch and said lower catch, said distance between said upper catch and said lower catch being greater than a distance between adjacent ones of said apertures.

* * * * *